US006371815B1

(12) United States Patent
Wetzel et al.

(10) Patent No.: US 6,371,815 B1
(45) **Date of Patent: *Apr. 16, 2002**

(54) ADAPTER PLUG FOR RECHARGEABLE ELECTRIC APPLIANCES

(75) Inventors: Matthias Wetzel, Bad Vilbel; Jochen Cimbal, Friedberg, both of (DE)

(73) Assignee: Braun GmbH (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/052,242

(22) Filed: Mar. 31, 1998

(30) Foreign Application Priority Data

Nov. 17, 1995 (DE) ..... 195 42 936

(51) Int. Cl.[7] ..... H01R 33/88
(52) U.S. Cl. ..... 439/651; 320/2; 439/135
(58) Field of Search ..... 439/651, 653, 439/135, 106, 105; 320/111, 115, 128, 108

(56) References Cited

U.S. PATENT DOCUMENTS 4,293,733 A 10/1981 Royer
4,536,694 A * 8/1985 McCarty et al. ..... 320/115
4,856,999 A * 8/1989 Flohr ..... 439/52
5,075,615 A * 12/1991 Dantis ..... 320/111
5,159,545 A * 10/1992 Lee ..... 439/173
5,334,076 A * 8/1994 Shinozuka ..... 320/115
5,542,852 A * 8/1996 Hsueh ..... 439/135
5,736,830 A * 4/1998 Weng ..... 320/115

FOREIGN PATENT DOCUMENTS

DE 8329691 U 1/1984
DE 8401378 U 6/1984
EP 0085935 2/1983

* cited by examiner

*Primary Examiner*—Renee Luebke
*Assistant Examiner*—Briggitte R. Hammond
(74) *Attorney, Agent, or Firm*—Fish & Richardson P.C.

(57) ABSTRACT

The invention is directed to an adapter plug in combination with a rechargeable electric appliance for personal use, such as a dry shaving apparatus, the adapter plug equipped with flat contact pins, having a plug case with contact pins for connecting to a socket-outlet and a case wall provided with accommodating holes suitable for receiving flat contact pins of the electric appliance in order to close a circuit, said accommodating holes being associated with a safety wall projecting from the case wall, in such fashion that during the process of inserting the flat contact pins in the accommodating holes the relative distance of the accommodating holes or of the flat contact pins of the electric appliance to the safety wall is at least equal to or greater than the safety clearance to be maintained to prevent voltage flashover. The safety wall has at least one recess for accommodating a housing of the electric appliance.

11 Claims, 2 Drawing Sheets

ADAPTER PLUG FOR RECHARGEABLE ELECTRIC APPLIANCES

This invention relates to an adapter plug for a rechargeable electric appliance for personal use, such as a dry shaving apparatus, equipped with flat contact pins, having a plug case with contact pins for connecting to a socket-outlet and a case wall provided with accommodating holes suitable for flat contact pins in order to close a circuit.

Various countries are known to have different, largely standardized plug systems. The actual plugs differ fundamentally first in the shape of their contact pins, which are round or flat, for example, and then in the distance between the contact pins. Appliance plugs with relatively close set contact pins of a blade-shaped configuration, also called flat contact pins, are known to be intended for a voltage range from 90 to 125 volts. Because of the small distance which may separate flat contact pins, it is customary in various countries where a plug system of this type is installed nation-wide in all households for these flat contact pins to also be fitted in electric appliances equipped with rechargeable storage cells in such a way as to be pushed and swiveled out of the appliance case, with the relative distances of the flat contact pins to the outer walls of the plug case or to the outer walls of the electric appliance being smaller than the compulsory plug contours and hence clearances and creepage distances from the user's hand laid down in some countries.

An electric appliance of the type initially referred to is known from German utility model G 83 29 691 (U1), for example. The appliance plug of the rechargeable shaving apparatus is slidably arranged at one end of the shaver housing. The two blade-shaped contact pins fastened to a plug case are pushed out of one of the two narrow sides of the shaver housing by means of an actuator switch arranged in the bottom of the housing in order to be connected to a socket-outlet of an electrical power supply. The socket-outlet, for example, may be a fixed arrangement in a room wall of a house or be part of an adapter plug.

Rechargeable electric appliances such as shavers of the type referred to in the foregoing are known to be equipped with charging circuits for rechargeable storage cells whose voltage range is conventionally 90 to 270 volts. It is thus possible for electric appliances of this type equipped with flat contact pins to be recharged also in those countries with a plug system based on contact pins of a different shape and arrangement. In order to be able to recharge an electric appliance equipped with flat contact pins, adapter plugs are available which have a shell-shaped case wall, two end walls, round contact pins projecting from one of the end walls, and accommodating holes suitable for flat contact pins that are provided in the end wall facing away from the end wall carrying the round contact pins and through which the flat contact pins of an electric appliance make contact with live parts of the projecting contact pins. An adapter plug of this type equipped with round contact pins, for example, is illustrated in FIG. 1. For safety reasons some countries approve a plug of this type only when the relative distance of the contact pins and the accommodating holes to the outer wall of the plug case is equal to or greater than the required and hence compulsory clearance and creepage distance to the user's hand. In countries with voltages of over 200 V this safety clearance amounts to 8 mm, for example.

From DE 84 01 378 U1 there is known an adapter plug equipped with round contact pins, whose end wall remote from the contact pins is provided with a circumferential safety wall. With this adapter plug it is only possible to connect an electric appliance with the help of a power cable equipped with flat contact pins; the direct connection of a rechargeable electric appliance equipped with flat contact pins is, however, not possible.

It is an object of the present invention to provide an adapter plug of the type initially referred to, which ensures the connection of a rechargeable electric appliance equipped with flat contact pins to a circuit while allowing for a sufficient safety clearance.

According to the present invention this object is accomplished with an adapter plug of the type initially referred to by providing the safety wall with at least one recess for the accommodation and connection of electric appliances equipped with flat contact pins.

An essential advantage of the invention is that it provides an adapter plug meeting the safety regulations simply by re-designing and rearranging a safety wall that already exists. Furthermore, as the embodiments shown in FIGS. 3 and 4 show, it is possible to manufacture the adapter plug according to the invention at lower cost as the result of saving material.

In an embodiment of the present invention, the safety wall is cylindrically shaped and provided with a U-shaped recess for connecting the adapter plug to the flat contact pins of the electric appliance.

According to a further embodiment of the present invention, the safety wall sections are arranged parallel to each other on the case wall.

According to yet another embodiment which is adapted preferably to a specific rechargeable electric appliance such as a shaving apparatus having push-out flat contact pins, provision is made for the distance between opposite safety walls to be equal to the distance between two opposite walls of the electric appliance to be accommodated or to the thickness of the appliance.

According to a preferred embodiment of the invention, the distance between opposite safety wall sections may be selected slightly larger than the distance between two opposite walls of an electric appliance to be accommodated or the thickness of the appliance while still allowing for the compulsory safety clearance.

Further advantages and details of the present invention will become apparent from the subsequent description and the accompanying drawing illustrating a preferred embodiment.

Figure 1:
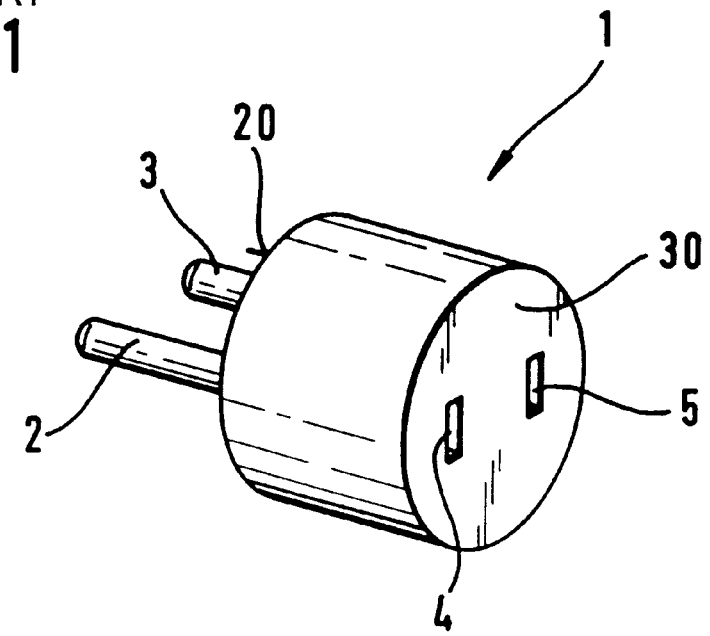
PRIOR ART Fig. 1
FIG. 1 is a view of an embodiment of a known adapter plug having round contact pins and slot-type accommodating holes in a plane end wall.

FIG. 1 shows an adapter plug of known design. The adapter plug comprises a cylindrically shaped plug case 1 which is closed at either end by case walls 20 and 30. While two round contact pins 2 and 3 project out of the case wall 20, the case wall 30 at the opposite end is provided with accommodating holes 4 and 5. The accommodating holes are of a slot-type configuration to receive therein flat contact pins, and electrically conducting components located in the interior of the plug case 1 ensure that a circuit is closed between the round contact pins 2 and 3 and the flat contact pins received in the accommodating holes 4 and 5.

Figure 2:
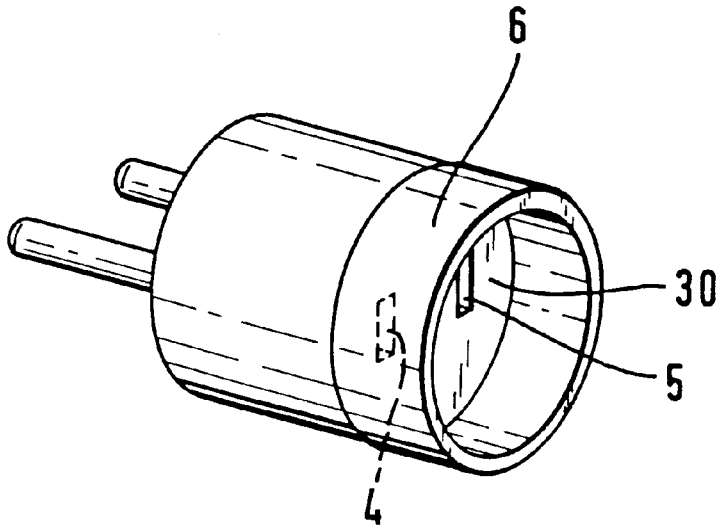
PRIOR ART Fig. 2
FIG. 2 is a view of a known adapter plug having round contact pins, slot-type accommodating holes and an annular safety wall on the end wall remote from the round contact pins.

FIG. 2 shows a further adapter plug of known design whose construction is largely the same as that of the known adapter plug of FIG. 1. The only difference in construction is that an annular safety wall 6 is provided on the essentially plane case wall 30.

Figure 3:
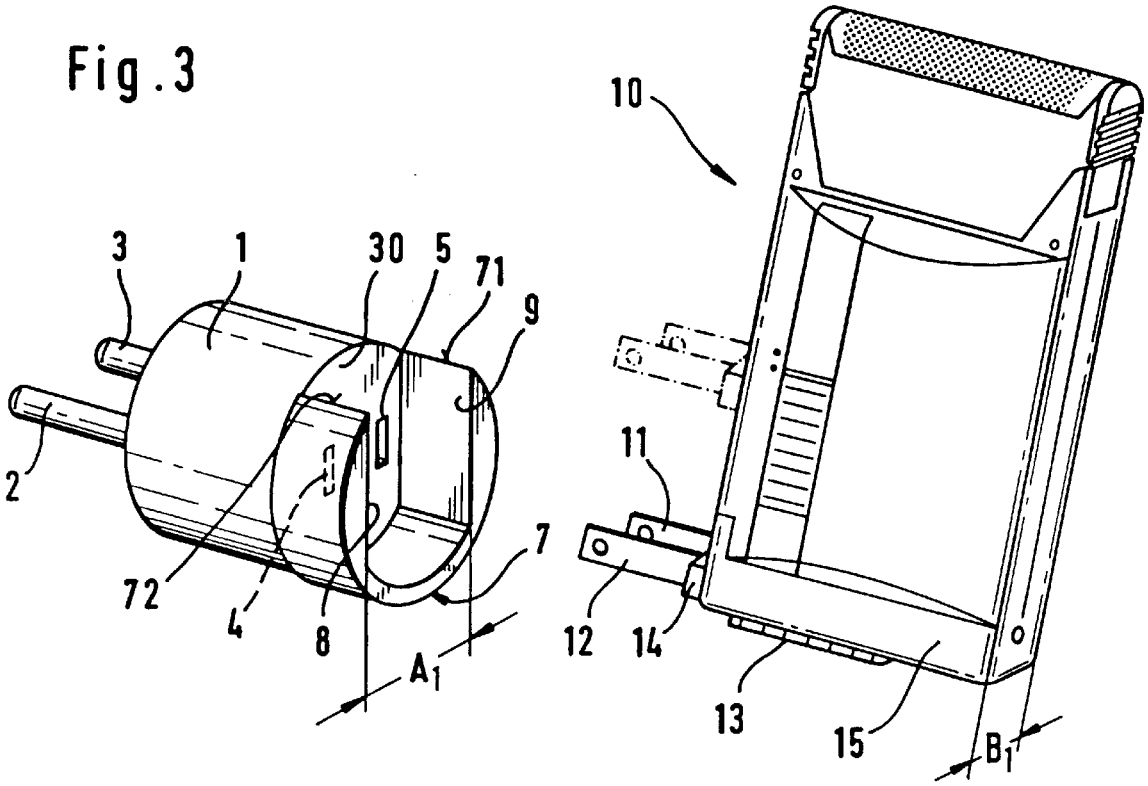
FIG. 3 is a view of an adapter plug having a cylindrical safety wall in which a recess is provided, and of a shaving apparatus equipped with flat contact pins for connection to an adapter plug.

FIG. 3 shows an adapter plug with a plug case 1, two round contact pins 2 and 3, two accommodating holes 4 and 5 provided in the case wall 30 and suitable for receiving the flat contact pins 11 and 12 of an electric appliance 10, and a circumferential safety wall 7 cut out to provide a U-shaped recess whose sides are formed by the plane case wall 30 and the edges 71 and 72 of the safety wall 7. Also illustrated in FIG. 3 is a dry shaving apparatus in the form of a rechargeable electric appliance 10. The two blade-type flat contact pins 11 and 12 fastened to a plug case 14 are pushed out of one of the two narrow sides of the shaver housing by means of an actuator switch 13 arranged in the housing bottom 15 and are locked in this position for connection to the adapter plug. The thickness B1 of the narrow side of the electric appliance 10 is slightly smaller than the distance A1 between the safety wall sections 8 and 9 formed by the U-shaped recess in the safety wall 7, thereby ensuing that the user inserting the plug is unable to touch or come close to the flat contact pins 11 and 12 with his fingers in the course of the flat contact pins 11 and 12 of the electric appliance 10 being inserted in the accommodating holes 4 and 5 in the plug case 1 of the adapter plug. The rechargeable electric appliance 10 is pushed with its flat contact pins 11 and 12 into the accommodating holes up to the point where a wall of the electric appliance or a wall of its plug case 14 comes up against the case wall 30.

Figure 4:
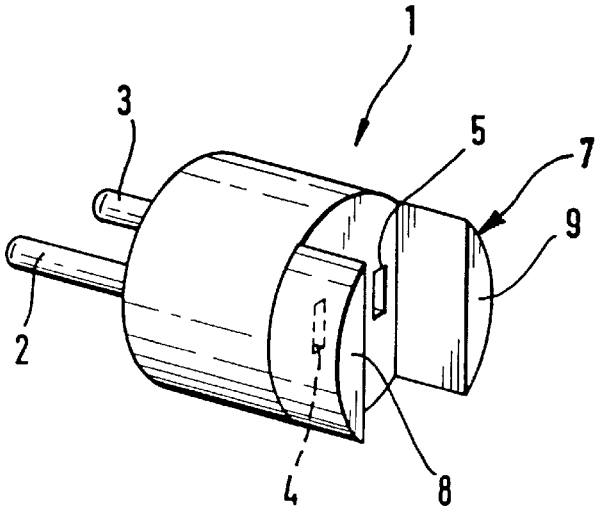
FIG. 4 is a view of an adapter plug having round contact pins projecting from an end wall, and safety wall sections and slot-type accommodating holes provided in the end wall at the opposite end.

FIG. 4 shows an adapter plug whose construction is essentially the same as that of the adapter plug of FIG. 1. Unlike the embodiment of FIG. 1, the case wall 30 on the adapter plug of FIG. 4 is provided with two recesses in otherwise circumferential safety wall 7 thus forming safety wall sections 8 and 9, which are preferably molded on the plug case wall. The two opposite safety wall sections 8 and 9 combine with the case wall 30 to form a U-shaped fork structure that gurantees the accommodation and connection of electric appliances 10 equipped with flat contact pins 11 and 12. Furthermore, the embodiment of an adapter plug according to FIG. 4 enables the accommodation and connection of a rechargeable electric appliance 10, whose flat contact pins 11 and 12 are located far above the housing bottom 15 of the electric appliance 10, as indicated in addition by the dot-and-dash lines on the dry shaving apparatus illustrated in FIG. 3, for example. In this embodiment the actuator switch 13 is located on the back of the appliance 10.

What is claimed is:

1. A combination comprising an adaptor plug and a rechargeable electric appliance to be accommodated by the adaptor plug, the electric appliance having a housing and equipped with flat contact pins that are compatible with a 90–125 volt wall outlet, said adaptor comprising:

round contact pins for connecting to a socket-outlet;

a case wall provided with accommodating holes suitable for receiving the flat contact pins of the appliance in order to close a circuit, wherein the accommodating holes have a flat profile that is complementary to the flat shape of the flat contact pins of the appliance and are spaced from each other a sufficient distance to prevent voltage flashover between the accommodating holes;

a circumferential safety wall projecting from the case wall, the circumferential safety wall having a recess for accommodating the housing of the rechargeable electric appliance said circumferential safely wall being associated with said accommodating holes such that said circumferential safety wall limits available directions of approach to directions corresponding to said recess for any part of a hand which is inserting the flat contact pins of the electric appliance into the accommodating holes from coming within a predetermined distance from the flat contact pins when said flat contact pins make an electrical connection in the accommodating holes, said predetermined distance being sufficient to prevent voltage flashover between the flat contact pins and said hand.

2. The combination adapter plug and rechargeable electric appliance of claim 1, wherein the circumferential safety wall is cylindrically shaped and said recess is a U-shaped recess for receiving the electric appliance.

3. The combination adapter plug and rechargeable electric appliance of claim 1, wherein the recess has a width greater than a maximum distance between the accommodating holes.

4. The combination adapter plug and rechargeable electric appliance of claim 1, wherein said circumferential safety wall has two recesses that separate the circumferential safety wall into two wall sections, each projecting from the case wall.

5. The combination adapter plug and rechargeable electric appliance or claim 4, wherein opposing surfaces of said two wall sections are arranged parallel to each other.

6. A combination comprising an adapter plug and a rechargeable electric appliance to be accommodated by the adapter plug, the rechargeable electric appliance having a housing defined by two sets of opposite side walls, the appliance equipped with flat contact pins that are compatible with a 90–125 volt wall outlet, said adaptor comprising:

round contact pins for connecting to a socket-outlet;

a case wall provided with accommodating holes suitable for receiving the flat contact pins of the appliance in order to close a circuit, wherein the accommodating holes have a flat profile that is complementary to the flat shape of the flat contact pins of the appliance and are spaced from each other a sufficient distance to prevent voltage flashover between the accommodating holes;

a circumferential safety wall projecting from the case wall, the circumferential safety wall having two recesses that separate the circumferential safety wall into two wall sections, said two wall sections being arranged to accommodate the housing of the rechargeable electric appliance and being associated with said accommodating holes such that said two wall sections limit available directions of approach to directions corresponding to said two recesses for any part of a hand which is inserting the flat contact pins of the electric appliance into the accommodating holes from coming within a predetermined distance from the flat contact pins when said flat contact pins make an electrical connection in the accommodating holes, said predetermined distance being sufficient to prevent voltage flashover between the flat contact pins and said hand, and wherein a smallest distance between the two wall sections is equal to a distance between two opposite walls of the housing of the electric appliance to be accommodated.

7. The combination adapter plug and rechargeable electric appliance of claim 6, wherein opposing surfaces of said two wall sections are arranged parallel to each other.

8. The combination adapter plug and rechargeable electric appliance of claim 7, wherein the smallest distance between the two wall sections is slightly larger than the distance between two opposite walls of the housing of the electric appliance to be accommodated.

9. A combination comprising an adapter plug and a rechargeable electric appliance to be accommodated by the adapter plug, the rechargeable electric appliance having a housing defined by two sets of opposite side walls, the appliance equipped with flat contact pins that are compatible with a 90–125 volt wall outlet, said adaptor comprising:

round contact pins for connecting to a socket-outlet;

a case wall provided with accommodating holes suitable for receiving the flat contact pins of the appliance in order to close a circuit, wherein the accommodating holes have a flat profile that is complementary to the flat shape of the flat contact pins of the appliance and are spaced from each other a sufficient distance to prevent voltage flashover between the accommodating holes;

a circumferential safety wall projecting from the case wall, the circumferential safety wall having two recesses that separate the circumferential safety wall into two wall sections, said two wall sections being arranged to accommodate the housing of the rechargeable electric appliance and being associated with said accommodating holes such that said two wall sections limit available directions of approach to directions corresponding to said two recesses for any part of a hand which is inserting the flat contact pins of the electric appliance into the accommodating holes from coming within a predetermined distance from the flat contact pins when said flat contact pins make an electrical connection in the accommodating holes, said predetermined distance being sufficient to prevent voltage flashover between the flat contact pins and said hand, and wherein a smallest distance between the two wall sections is equal to a minor principal dimension of the housing of the appliance, said minor principal dimension being defined by a smallest distance between external surfaces of opposite walls of the housing.

10. The combination adapter plug and rechargeable electric appliance of claim 9, wherein opposing surfaces of said two wall sections are arranged parallel to each other.

11. The combination adapter plug and rechargeable electric appliance of claim 10, wherein the smallest distance between the two wall sections is slightly larger than the minor principal dimension of the appliance.

* * * * *

UNITED STATES PATENT AND TRADEMARK OFFICE

CERTIFICATE OF CORRECTION

PATENT NO. : 6,371,815 B1
DATED : April 16, 2002
INVENTOR(S) : Matthias Wetzel and Jochen Cimbal It is certified that error appears in the above-identified patent and that said Letters Patent is hereby corrected as shown below:

Column 4,
Line 7, replace “safely” with -- safety --
Line 32, replace “or” with -- of --

Signed and Sealed this

Twenty-third Day of September, 2003

JAMES E. ROGAN
*Director of the United States Patent and Trademark Office*